US008016728B2

(12) United States Patent
Derry

(10) Patent No.: US 8,016,728 B2
(45) Date of Patent: Sep. 13, 2011

(54) CROSSBAR POSITIONING APPARATUS AND METHOD

(76) Inventor: Dale Derry, Fairfax, CA (US)

( * ) Notice: Subject to any disclaimer, the term of this patent is extended or adjusted under 35 U.S.C. 154(b) by 137 days.

(21) Appl. No.: 12/231,323

(22) Filed: Aug. 29, 2008

(65) Prior Publication Data

US 2009/0275444 A1 Nov. 5, 2009

Related U.S. Application Data

(60) Provisional application No. 60/967,134, filed on Aug. 31, 2007.

(51) Int. Cl.
*A63B 5/02* (2006.01)
*A63B 1/00* (2006.01)

(52) U.S. Cl. ..... 482/17; 482/38

(58) Field of Classification Search ..... 482/14–17, 482/37–42, 104, 129, 133, 143; 119/705; 248/323, 327, 328

See application file for complete search history.

(56) References Cited

U.S. PATENT DOCUMENTS

| | | | | | |
|---|---|---|---|---|---|
| 924,075 | A | * | 6/1909 | Johnson | 5/630 |
| 3,497,212 | A | * | 2/1970 | Gotcher | 482/17 |
| 4,227,688 | A | * | 10/1980 | Senoh et al. | 482/38 |
| 4,245,838 | A | * | 1/1981 | Gordon | 482/17 |
| 4,257,590 | A | * | 3/1981 | Sullivan et al. | 482/94 |
| 4,316,609 | A | * | 2/1982 | Silberman | 482/102 |
| 4,598,906 | A | * | 7/1986 | Sansbury | 482/17 |
| 4,632,390 | A | * | 12/1986 | Richey | 482/96 |
| 5,029,850 | A | * | 7/1991 | van Straaten | 482/125 |
| 5,221,240 | A | * | 6/1993 | Mann et al. | 482/40 |
| 5,788,606 | A | * | 8/1998 | Rich | 482/27 |

FOREIGN PATENT DOCUMENTS

GB 2059784 A * 4/1981

* cited by examiner

*Primary Examiner* — Allana Lewin
(74) *Attorney, Agent, or Firm* — Steven J. Adamson

(57) ABSTRACT

An extender device and system for adjusting the height of a crossbar analogue in pole vault, high jump, horse jumping or other crossbar clearing activities. The system may include a plurality of pulley like devices that maintain a cord spaced about a practice structure. A crossbar analogue is coupled to the cord and the cord arranged so that the crossbar analogue may be readily moved upward or downward. An extender is disclosed that facilitates arrangement and movement of the cord and crossbar analogue in this manner.

4 Claims, 6 Drawing Sheets

CROSSBAR POSITIONING APPARATUS AND METHOD

CROSS REFERENCE TO RELATED APPLICATIONS

This application claims the benefit of U.S. Provisional Application No. 60/967,134, filed Aug. 31, 2007, entitled "Pole Vault Training Apparatus and Method" and having the same inventor as above.

FIELD OF THE INVENTION

The present invention relates to positioning a crossbar during training for pole vault, high jump or another crossbar clearing activity. More specifically, the present invention relates to the rapid and effective re-positioning of the height of a crossbar or crossbar analogue during training.

BACKGROUND OF THE INVENTION

During training for pole vaulting, several vaulters may use the same pole vault structure and pit equipment at the same time. The vaulters, however, are typically not vaulting at the same crossbar height. This requires a person to adjust the height of the standard for each vaulter, and then mount the crossbar on the height adjusted standard.

Adjusting the height of the standard is disadvantageously time consuming, reducing the number of training attempts a vaulter may have and the time interval between attempts. A smaller time interval between attempts may be very important in teaching/reinforcing proper technique and for providing sufficiently rapid feedback to efficiently and effectively develop pole vaulting skills.

This same challenge is faced in other activities that involve clearing a crossbar, such as high jump and equestrian fence jumping, etc.

A need exists for a mechanism and a training system that permits ready and rapid adjustment of the height of the crossbar or crossbar analogue so that among other benefits, the crossbar height may be quickly adjusted between attempts.

SUMMARY OF THE INVENTION

Accordingly, it is an object of the present invention to provide a mechanism that affords the rapid adjustment of a crossbar or crossbar analogue in a pole vault, high jump or other crossbar supporting structure to enhance training.

The present invention includes both a system that achieves these objectives and an extender device that may be part of that system. The extender device as described in more detail below may mount to a support structure such as a standard and have on an interior side a mechanism for engaging a crossbar and on an exterior side a structure for passing a movable cord that supports a crossbar analogue.

These and related objects of the present invention are achieved by use of a crossbar positioning apparatus and method as described herein.

The attainment of the foregoing and related advantages and features of the invention should be more readily apparent to those skilled in the art, after review of the following more detailed description of the invention taken together with the drawings.

DETAILED DESCRIPTION

Figure 1:
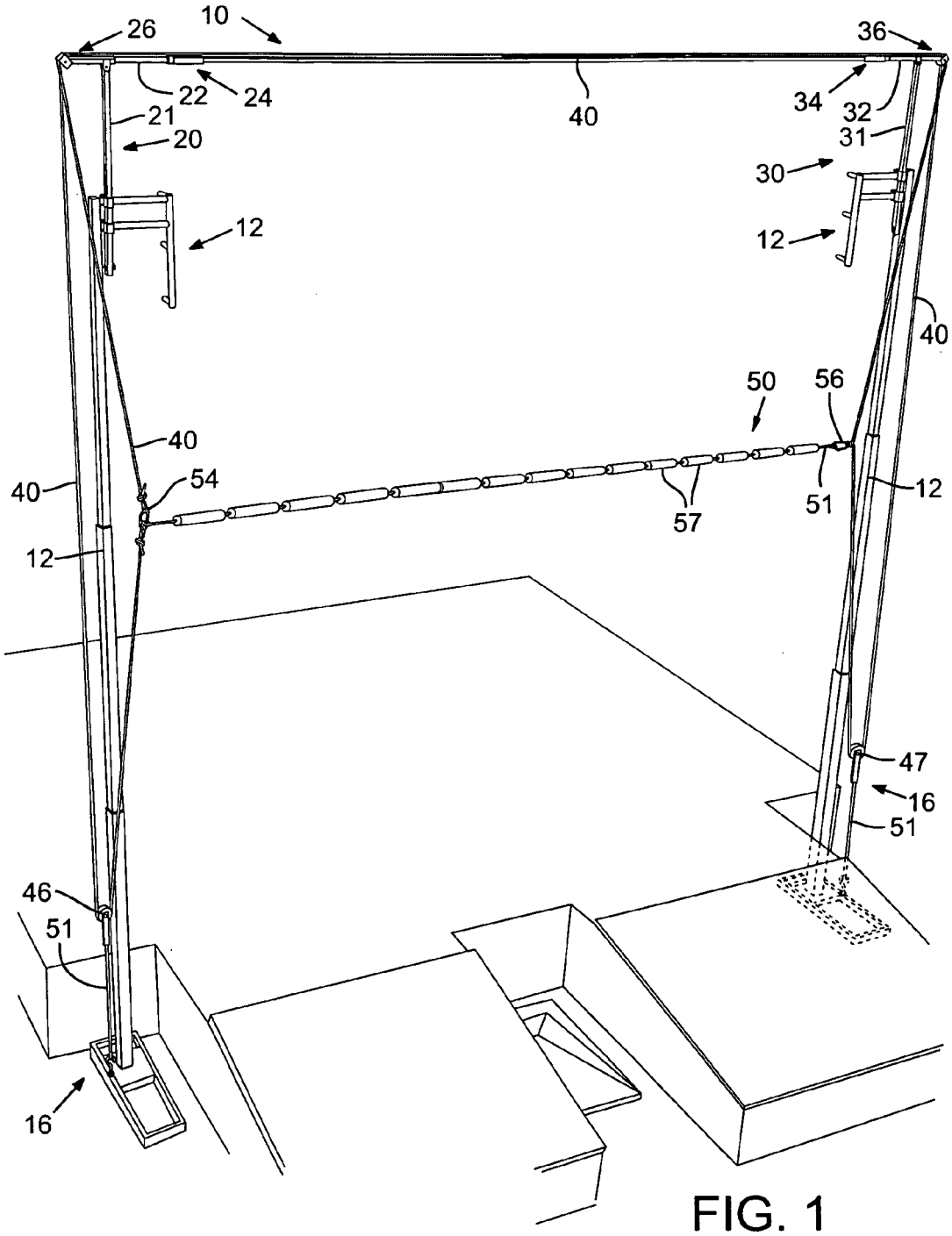
FIG. 1 is a perspective view of a crossbar positioning system for use in pole vault training in accordance with the present invention is shown.

Referring to FIG. 1, a perspective view of a crossbar positioning system 10 in accordance with the present invention is shown. System 10 may include a pair of crossbar holding, cord passing devices (hereinafter referred to as "extenders") 20,30 that securely mount to conventional standards 12. In the embodiment of FIG. 1, each extender includes a vertical member 21,31 and a horizontal member 22,32. The horizontal member may be pivotally connected to the vertical member to permit folding to achieve a compact shape for storage and transport.

The exterior end of each horizontal member may include a cord passing structure that preferably contains a pair of pulleys 26,36. It can be seen in FIG. 1 that these pulleys redirect cord 40 and may thus be regarded as cord redirecting structures. The interior end 24,34 of each horizontal member may include a protrusion 24,34 (obscured by crossbar 14) that fits into, under, or otherwise engages a crossbar 14 and a stopper 25,35 that extends in a dimension substantially perpendicular to the longitudinal axis of the horizontal member or engaging protrusion 24,34.

A cord, of natural or synthetic material, is preferably provided with system 10 and runs continuously through two pulleys 46,47 located at base 16 of the standards and pulley pairs 26,36. It can be seen from FIG. 1 that pulleys 46,47 are unidirectional cord passing structures (redirecting a single cord) and pulleys 26,36 are bidirectional cord passing structures (redirecting two cords in different directions). Tie down straps 51 are preferably secured to pulleys 46,47 and a base of the standards 12. The straps are cinched down to render cord 40 taut. Starting at the lower right hand side of FIG. 1, cord 40 is configured as a loop and runs continuously upward from pulley 46, is re-directed through one of pulley pair 26, runs along crossbar 14, is re-directed downward through one of pulley pairs 36, extends downward to pulley 47, then upward through the other of pulley pair 36, continues back along crossbar 14 to the other of pulley pair 26 and then downward toward pulley 46 where it rejoins the upward running segment, completing the loop.

Figure 4:
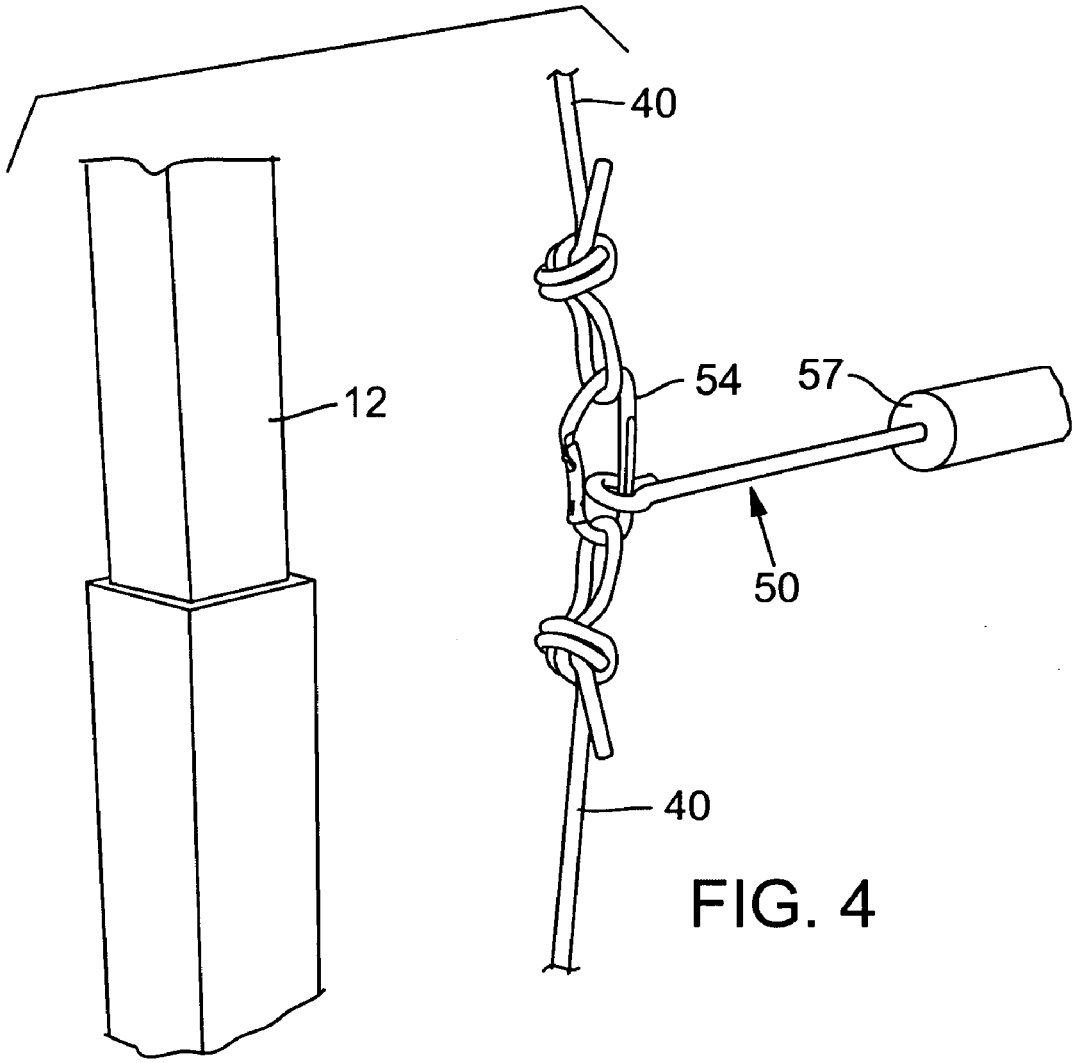
FIGS. 4-5 are perspective views that illustrates the mounting of a crossbar analogue in accordance with the present invention.
Figure 5:
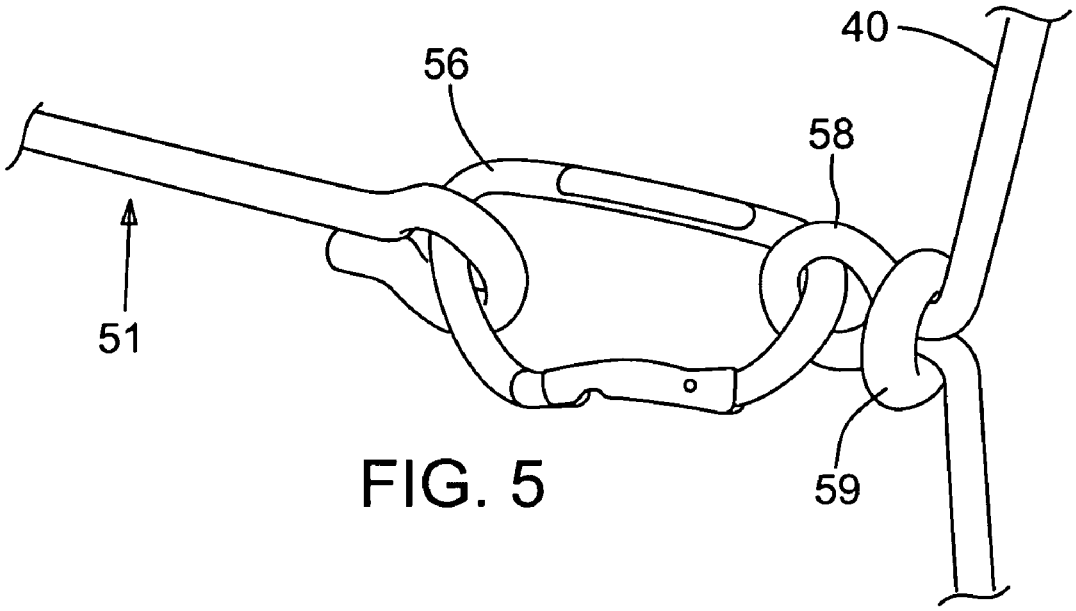

A crossbar "analogue" or "substitute" 50 is preferably coupled to cord 40. This may be a bungee cord or a length of surgical tubing or the like 51, or something more rigid. In the embodiment of FIG. 1, the crossbar analogue 50 may be coupled by a carabiner or other releasable fastening device 54 on one end and a carabiner or related device 56 on the other end. These elements are shown in FIGS. 4-5, respectively. The crossbar analogue itself may be formed of an elastic material on which cylindrical foam pads 57 or the like are attached to increase the visibility of the crossbar analogue and to reduce the possibility of entanglement by a vaulter or jumper in the crossbar analogue.

The crossbar analogue 50 is preferably coupled to the forward length of cord 40 towards the left hand standard and on the rearward length of cord 40 by the right hand standard, or vice versa. With this configuration, a coach, trainer or fellow athlete standing by one of the standards can pull cord 40 downward or upward which in turn causes the crossbar analogue to move upward or downward while remaining substantially level. In this manner, the practice crossbar height can be rapidly and readily adjusted between vaulters/jumpers. This is achieved because the pulley structure described herein causes the inside cord at one standard to move as much as the outside cord at the other standard (and vice versa).

The flexible nature of the crossbar analogue permits a user to vault without the necessity of remounting a crossbar. If an actual crossbar is desired, however, brackets for holding a crossbar on the cord itself may be mounted to the cord.

Figure 2:
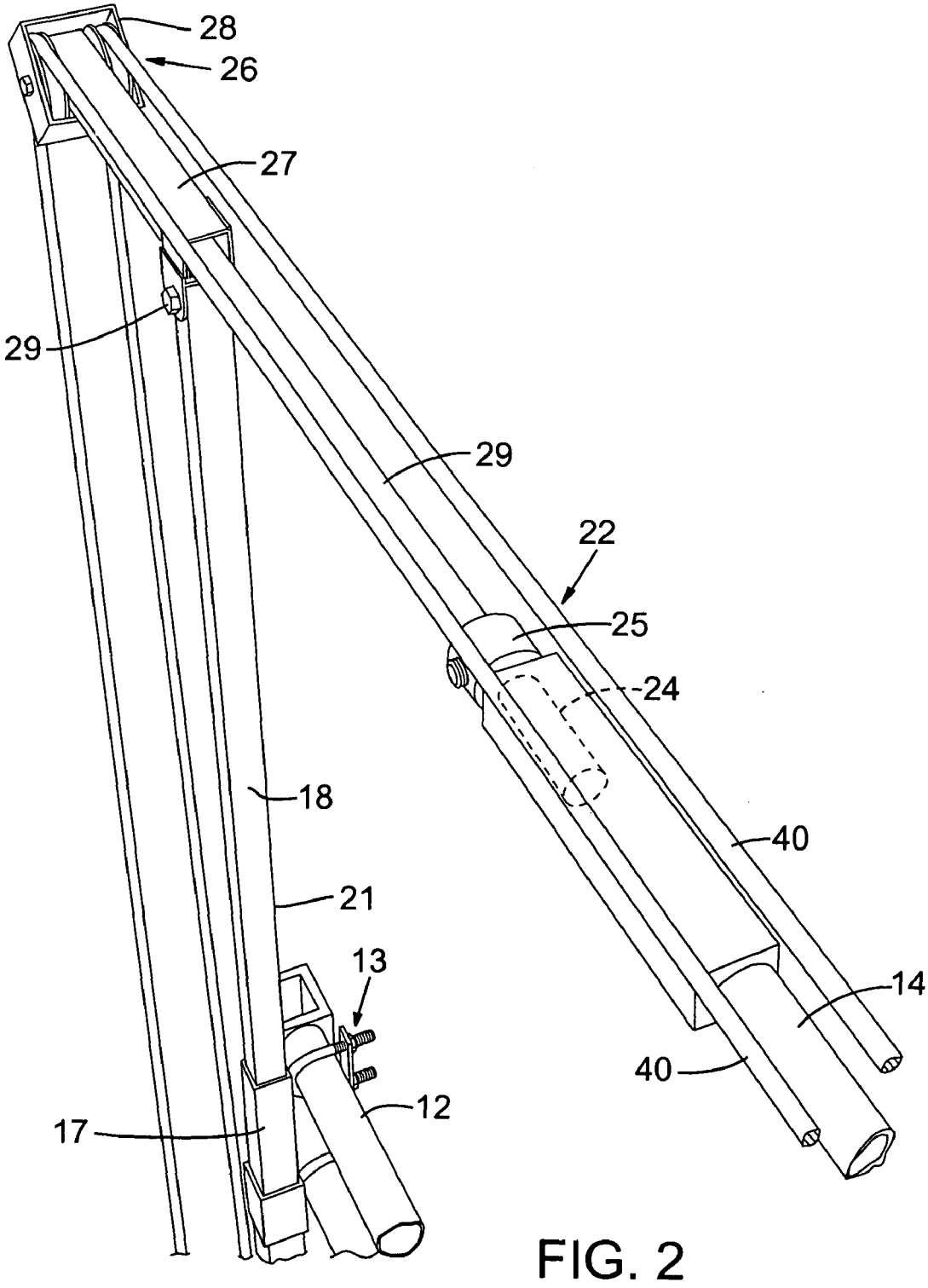
FIGS. 2-3 are perspective views of the crossbar holding, cord passing device of FIG. 1 in accordance with the present invention.
Figure 3:
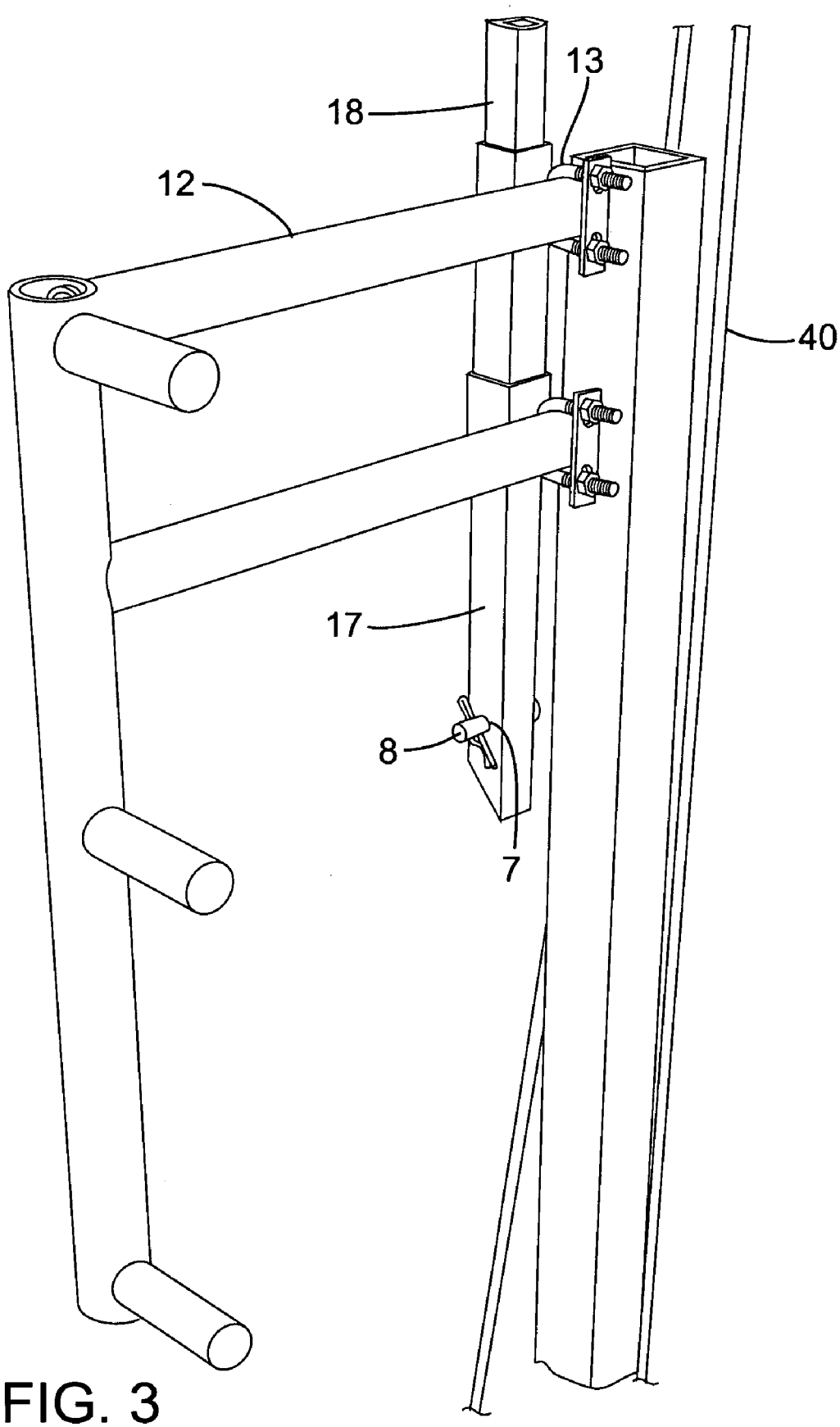

Referring to FIGS. 2 and 3, a top perspective sectional view and a side perspective sectional view of extender 20 in accordance with the present invention are respectively shown. Extender 30 is preferably made in a similar manner.

FIG. 2 illustrates horizontal member 22 connected through pivot 29 to the vertical member 21. The horizontal member may include a housing 27 that forms a base for mounting pulley pair 26 and a shield 28 that serves to protect the pulley and cord from fouling and to keep the cord within the guides or pulleys 26. A rod 29 preferably extends from housing 27 toward crossbar 14. Protrusion 24, provided at the interior end of rod 29, is inserted into crossbar 14 in the embodiment of FIG. 2 (and is thus shown in phantom lines). Crossbars are typically hollow. Stop 25 is provided adjacent protrusion 24 and prevents protrusion 24 from extending further into the crossbar. Note that protrusion 24 could be a platform on which the crossbar sits or be otherwise configured to engage/retain the crossbar.

The lower end of vertical member 21 preferably includes a releasable fastening mechanism 13 such as a C-bolt that may be welded to the base of vertical member 21 and fastened to standard 12. C-bolts and the like are known in the art to achieve attachment positive retention.

Vertical member 21 preferably includes a housing 17 from which extends shaft 18. The position of shaft 18 within housing 17 may be height adjusted, thereby adjusting the height of the horizontal member 22 relative to the standard.

FIG. 3 illustrates a base of vertical member 21, showing releasable fastening mechanism 13 affixed to housing 17 and fastened to standard 12. Shaft 18 may have a plurality of holes that align with a guide hole 7 in housing 17. A releasable pin 8 may be placed through hole 7 and a corresponding hole in shaft 18 to adjust the height of the shaft (and horizontal member 22). This permits height adjustment of the horizontal member, including setting the height at what is generally regarded as high school height or college height.

FIG. 4 illustrates a carabiner 54 preferably joining two ends of cord 40. The releasable nature permits the training system of the present invention to be readily set up and broken down as needed. The crossbar analogue 50 may also releasably couple through device 54.

FIG. 5 illustrates position adjustable loop ring 59 that may be slid onto cord 40 opposite carabiner 54 (of FIG. 4) so that the crossbar analogue is positioned in a level position. Ring 59 forms a loop 58 in cord 40 onto which carabiner or clip 56 may be attached. The crossbar analogue is then attached to the clip.

Figure 6:
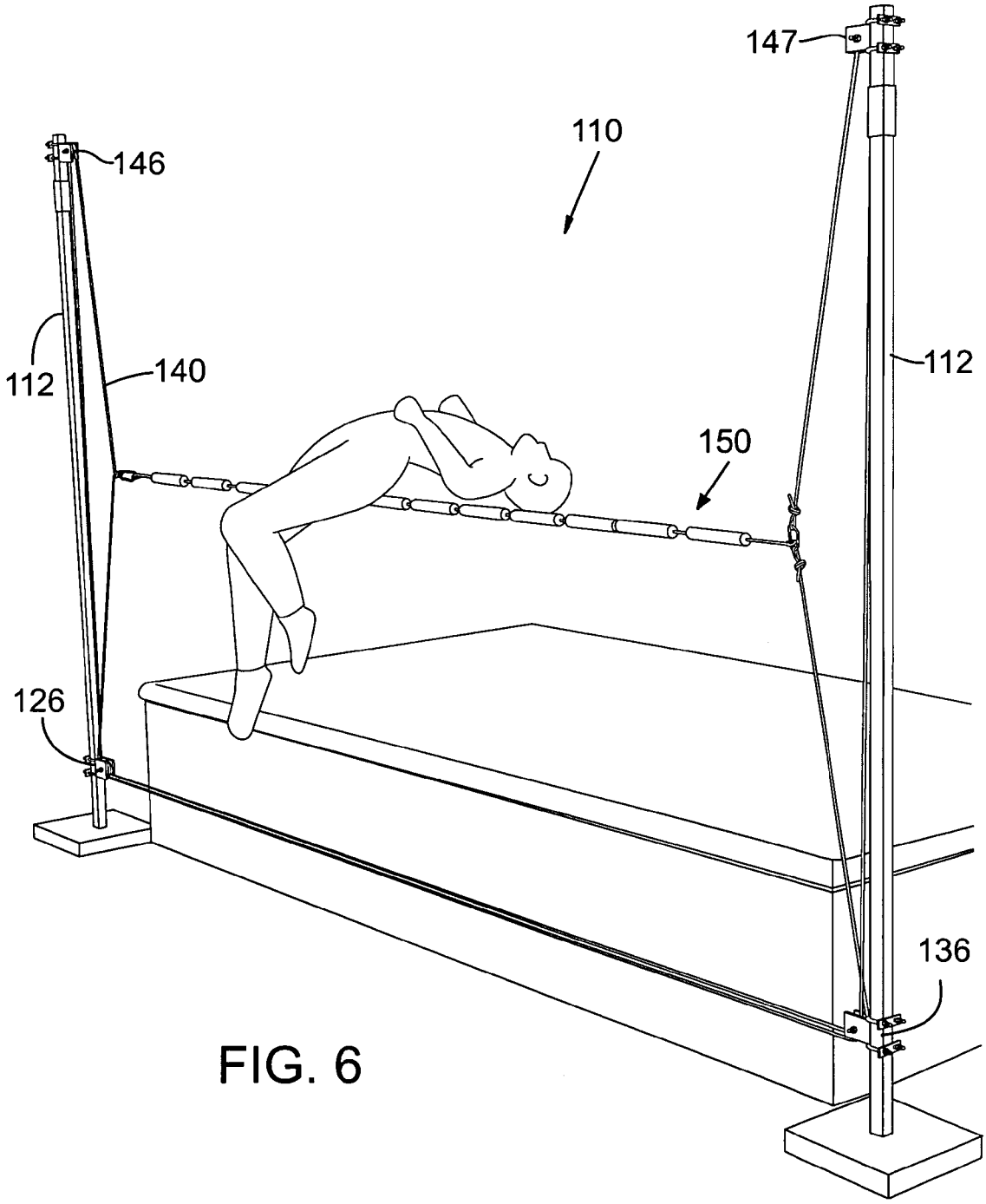
FIGS. 6-7 are perspective views of a crossbar positioning system for use with high jump and equestrian jumping in accordance with the present invention, respectively.

Referring to FIG. 6, a perspective view of a related system 110 for adjusting crossbar height in high jump training in accordance with the present invention is shown. System 110 has a pulley arrangement that is reversed from that of the pole vault system of FIG. 1 in that system 110 has single pulleys 146,147 at the top and pulley pairs 126,136 at the bottom. Cord 140 is arranged continuously about these pulleys in a manner similar to that described above for system 10. An elastic crossbar analogue 150 is preferably coupled in a level position to cord 140 (as crossbar analogue 50 was coupled in a level position to cord 40 of the system of FIG. 1).

Note that while the pulleys are shown in a reverse arrangement in FIG. 6, extenders 20,30 of FIG. 1 could be used here, with the pulleys arranged as in FIG. 1, particularly if desire to support the standards 112 in an upright position and to position the crossbar high enough above a jumper as to not interfere with a jump.

Figure 7:
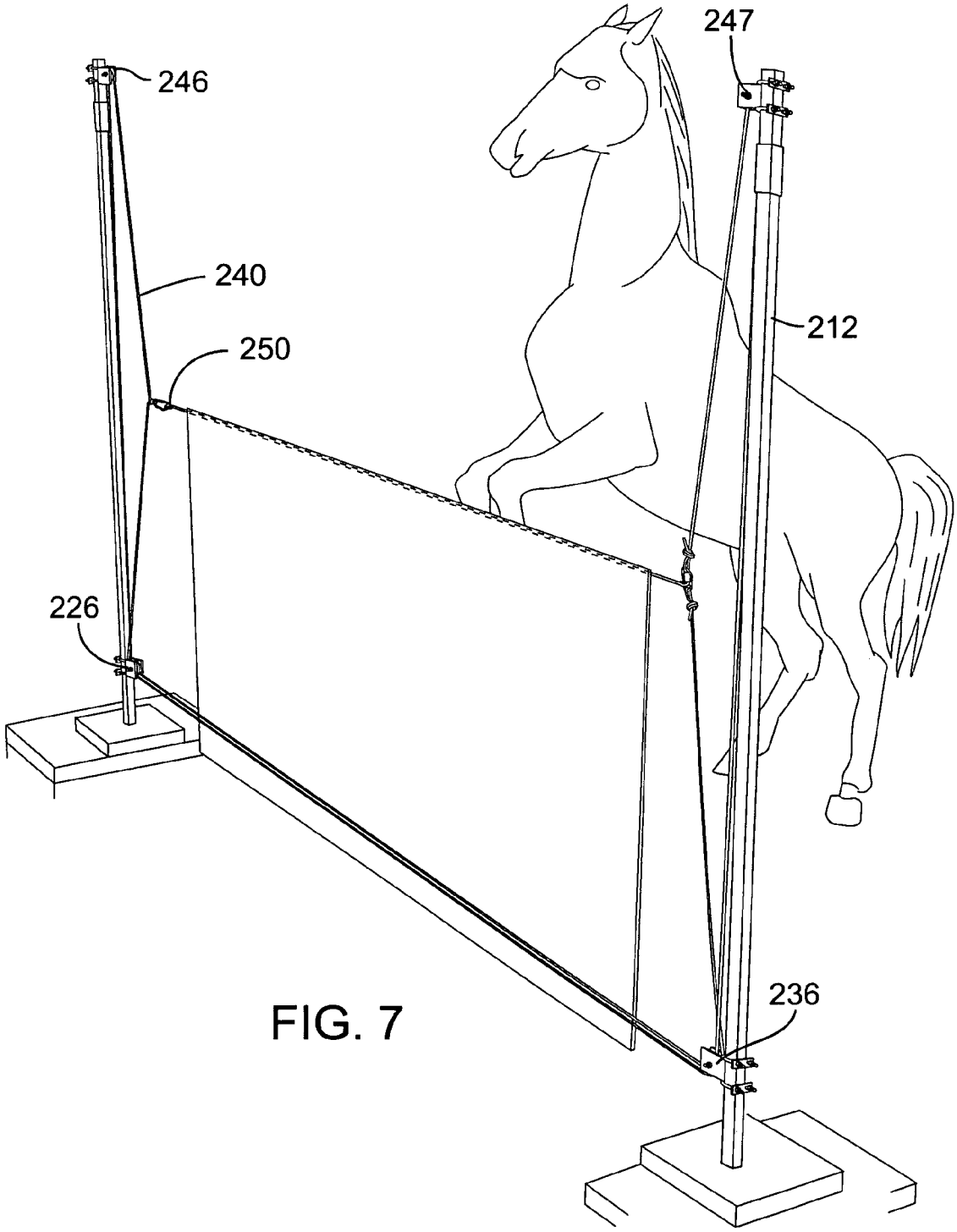

FIG. 7 illustrates a system 210 that is similar to system 110 of FIG. 6, yet designed for equestrian jumping. System 210 includes pulleys 246,247, pulley pairs 226,236, cord 240, crossbar analogue 250 and standards 212. System 210 operates in a manner similar to system 110.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

The invention claimed is:

1. A system for adjusting the height of a crossbar, comprising:

a first and a second vertically disposed supports;

a first and a second unidirectional cord passing structures, each respectively coupled to the first and second vertical supports;

a first and a second multiple and bidirectional cord passing structures, each respectively coupled to the first and second vertical supports;

a cord of sufficient length to continuously pass through the first and second unidirectional structures and the first and second bidirectional structures as those structures are mounted on the vertical supports;

a mechanism for releasably coupling two ends of the cord to achieve the continuous cord arrangement; and a crossbar analogue that is configured for releasable attachment to the cord at two locations that are substantially horizontally level;

wherein the cord is arranged in the passing structures such that upward or downward movement of the cord proximate one of the vertical supports causes a similar upward or downward movement of the cord proximate the other vertical support such that the crossbar analogue moves up or down while maintain a substantially level position.

2. The system of claim 1, wherein the passing structures are pulleys.

3. The system of claim 1, further comprising first and second extenders, each extender having (1) a mechanism for releasably coupling to one of the vertically disposed supports and (2) a protrusion and stopper mechanism for engaging a crossbar, wherein the first and second bidirectional passing structures are respectively mounted on the first and second extenders.

4. The system of claim 1, wherein the crossbar analogue is formed of an elastic material.

* * * * *